US009131794B2

(12) United States Patent
McClain

(10) Patent No.: US 9,131,794 B2
(45) Date of Patent: Sep. 15, 2015

(54) CADDY FOR INVERTED DISPENSER STORAGE

(71) Applicant: SalMac Innovations, LLC, Chandler, AZ (US)

(72) Inventor: Michael Glenn McClain, Chandler, AZ (US)

(73) Assignee: SALMAC INNOVATIONS, LLC, Chandler, AZ (US)

( * ) Notice: Subject to any disclaimer, the term of this patent is extended or adjusted under 35 U.S.C. 154(b) by 0 days.

(21) Appl. No.: 14/196,424

(22) Filed: Mar. 4, 2014

(65) Prior Publication Data

US 2014/0246392 A1 Sep. 4, 2014

Related U.S. Application Data

(60) Provisional application No. 61/772,219, filed on Mar. 4, 2013.

(51) Int. Cl.

| | |
|---|---|
| ***A47B 73/00*** | (2006.01) |
| ***A47B 43/00*** | (2006.01) |
| ***A47B 47/00*** | (2006.01) |
| ***A47B 57/00*** | (2006.01) |
| ***A47G 23/02*** | (2006.01) |
| ***A47F 5/10*** | (2006.01) |

(52) U.S. Cl.

CPC ..... *A47G 23/02* (2013.01); *A47B 43/00* (2013.01); *A47B 73/00* (2013.01); *A47F 5/10* (2013.01); *A47G 23/0241* (2013.01)

(58) Field of Classification Search

CPC ..... A47L 19/04; A47B 73/00; A47B 73/004; A47B 73/008; A47B 43/00; A47B 46/00; A47B 73/006; A47J 47/20; A47J 47/16; A47F 5/13; A47F 5/0084; A47F 13/085; A47F 7/28; A47F 5/10; A47G 23/02; D06F 95/002; D06F 57/08; D06F 57/10; D06F 57/06; D06F 57/127

USPC ..... 211/195, 12, 85.15, 85.24, 200, 74, 211/197; 248/164, 166, 431; 108/118

See application file for complete search history.

(56) References Cited

U.S. PATENT DOCUMENTS

| | | | | | |
|---|---|---|---|---|---|
| 222,542 | A | * | 12/1879 | Stearns | 211/200 |
| 329,150 | A | * | 10/1885 | Eaton | 211/200 |
| 932,344 | A | * | 8/1909 | Starbard | 248/106 |
| 1,971,523 | A | * | 8/1934 | Feingold | 211/41.5 |
| 2,211,227 | A | * | 8/1940 | Feindel | 248/106 |
| 2,340,645 | A | * | 2/1944 | Creed | 248/107 |
| 2,403,324 | A | * | 7/1946 | Anderson | 69/19 |
| 2,648,513 | A | * | 8/1953 | Groff | 248/107 |
| 2,746,703 | A | * | 5/1956 | Emery | 248/150 |
| 3,119,497 | A | * | 1/1964 | Levy | 211/204 |
| 3,374,047 | A | * | 3/1968 | Gatchell | 359/727 |
| 3,615,150 | A | * | 10/1971 | Indrunas | 141/375 |

(Continued)

OTHER PUBLICATIONS

Kitchenart.com website: http://www.kitchenart.com/ProductDetails.asp?ProductCode=18200, bottoms up product, date retrieved from website is May 8, 2014.

*Primary Examiner* — Jennifer E Novosad

(74) *Attorney, Agent, or Firm* — Snell & Wilmer L.L.P.

(57) ABSTRACT

A foldable caddy is usable to store containers, for example condiment bottles, in an inverted orientation. In this manner, speed of dispensing is improved and waste is reduced. The caddy is foldable via a scissoring movement to open for use and to close for storage or transport.

11 Claims, 9 Drawing Sheets

(56) References Cited

U.S. PATENT DOCUMENTS

| | | | | | |
|---|---|---|---|---|---|
| D247,416 | S | * | 3/1978 | Berman et al. | D32/55 |
| 4,122,780 | A | * | 10/1978 | Brickman | 108/25 |
| 4,150,806 | A | * | 4/1979 | Dziuk | 248/154 |
| 4,212,400 | A | * | 7/1980 | Buchsteiner | 211/41.6 |
| 4,217,941 | A | * | 8/1980 | Catalano | 141/372 |
| 4,221,299 | A | * | 9/1980 | Taylor | 211/41.6 |
| 4,295,571 | A | * | 10/1981 | Meyer | 211/200 |
| 4,309,008 | A | * | 1/1982 | Sirks | 248/105 |
| 4,328,899 | A | * | 5/1982 | Krusche | 211/41.6 |
| D290,673 | S | * | 7/1987 | Imatt | D7/619.1 |
| 4,996,404 | A | * | 2/1991 | Skerker et al. | 219/732 |
| 5,002,246 | A | * | 3/1991 | Chaffin et al. | 248/153 |
| 5,234,116 | A | * | 8/1993 | Kristinsson et al. | 211/201 |
| 5,833,075 | A | * | 11/1998 | Czaplinski et al. | 211/41.2 |
| 6,591,991 | B2 | * | 7/2003 | Belle | 211/24 |
| 6,722,618 | B1 | * | 4/2004 | Wu | 248/166 |
| 7,168,580 | B2 | * | 1/2007 | Larimer et al. | 211/200 |
| 7,318,569 | B1 | * | 1/2008 | Bilotta | 248/97 |
| 7,475,785 | B1 | * | 1/2009 | Kidd | 211/85.15 |
| 7,490,798 | B2 | * | 2/2009 | Mann | 248/175 |
| 7,578,401 | B2 | * | 8/2009 | Schnitzer | 211/41.6 |
| D640,386 | S | * | 6/2011 | Rhoades et al. | D24/199 |
| 2003/0080073 | A1 | * | 5/2003 | Huang et al. | 211/40 |
| 2007/0012638 | A1 | * | 1/2007 | Van Eijk | 211/104 |
| 2007/0108143 | A1 | * | 5/2007 | Kilduff | 211/74 |
| 2008/0283480 | A1 | * | 11/2008 | Segall et al. | 211/41.6 |
| 2012/0248047 | A1 | * | 10/2012 | Tanabe et al. | 211/13.1 |
| 2014/0246392 | A1 | * | 9/2014 | McClain | 211/85 |

* cited by examiner

CADDY FOR INVERTED DISPENSER STORAGE

CROSS REFERENCE TO RELATED APPLICATIONS

This application claims priority to, and the benefit of, U.S. Provisional Application Ser. No. 61/772,219 entitled "BOTTOMS UP CADDY" and filed Mar. 4, 2013, the contents of which are incorporated herein by reference.

TECHNICAL FIELD

The present disclosure relates to storage, and in particular to storage of dispensing bottles to reduce product waste.

BACKGROUND

Many thick and/or viscous substances, for example condiments, glues, and/or the like, are difficult to dispense. Flexible containers can aid in dispensing, for example by permitting squeezing, but depending on the container design, much of the material remains in the container and is eventually wasted. Accordingly, improved storage and/or dispensing techniques and materials remain desirable.

SUMMARY

In an exemplary embodiment, a folding caddy system comprises a first caddy portion, and a second caddy portion pivotably coupled to the first caddy portion via a pin. The first caddy portion comprises a pair of legs, at least one support loop configured to receive, when the folding caddy system is in an open position, a portion of a container in an inverted position, and a bar.

In another exemplary embodiment, a method of using a container comprises positioning a folding caddy in an open position, inserting the container into the caddy in an inverted orientation, removing the container from the caddy to dispense material from the container, and reinserting the container into the caddy in an inverted orientation.

The contents of this summary section are provided only as a simplified introduction to the disclosure, and are not intended to be used to limit the scope of the appended claims.

BRIEF DESCRIPTION OF THE DRAWINGS

With reference to the following description and accompanying drawings.

DETAILED DESCRIPTION

The following description is of various exemplary embodiments only, and is not intended to limit the scope, applicability or configuration of the present disclosure in any way. Rather, the following description is intended to provide a convenient illustration for implementing various embodiments including the best mode. As will become apparent, various changes may be made in the function and arrangement of the elements described in these embodiments without departing from principles of the present disclosure.

For the sake of brevity, conventional techniques for materials handling, molding, fasteners, liquid storage, and the like may not be described in detail herein. Furthermore, the connecting lines shown in various figures contained herein are intended to represent exemplary functional relationships and/or physical couplings between various elements. It should be noted that many alternative or additional functional relationships or physical connections may be present in a practical folding caddy system.

Prior approaches for storage and dispensing of liquids, particularly highly viscous liquids, suffer from various deficiencies. For example, a significant amount of residue is often left, unused, within a rigid bottle or container. Additionally, the time to dispense the liquid can be excessive, particularly when waiting for a desired amount of the liquid to exit the container under the influence of gravity.

In contrast, these and other shortcomings of existing approaches may be overcome by utilizing principles of the present disclosure, for example as illustrated in various exemplary embodiments. For example, by utilizing a foldable caddy to hold liquid containers in an inverted position, residue is reduced, and dispensing times are improved.

Figure 1:
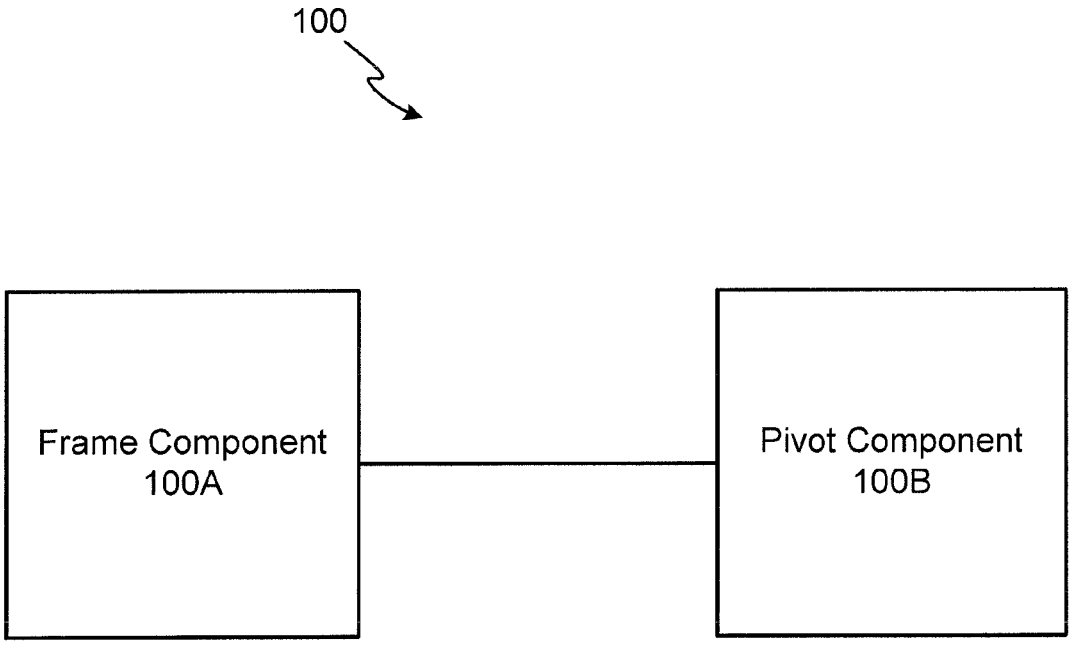
FIG. 1 is a block diagram of an exemplary folding caddy system in accordance with an exemplary embodiment.

As used herein, a folding caddy system may be any system configured to facilitate inverted storage of liquid and/or fluid containers. "Inverted" is utilized herein to mean an orientation of a container such that the cap, nozzle, or dispensing portion of the container is located below the rest of the container and/or facing at least partially downward. For example, an "inverted" position of a conventional ketchup bottle would be with the bottle cap lower than the bottom of the bottle. It will be appreciated that inverted can mean a declined angle, as well as a complete vertical inversion. In accordance with an exemplary embodiment, and with reference to FIG. 1, a folding caddy system 100 generally comprises a frame component 100A and a pivot component 100B. Frame component 100A is configured to provide structural support to folding caddy system 100. Frame component 100A is also configured to at least partially support at least one container in an inverted position. Pivot component 100B is coupled to at least one frame component 100A and is configured to allow frame component 100A to move, deform, and/or pivot, for example in a scissoring manner, in order to achieve an opened and/or closed orientation for folding caddy system 100.

In an exemplary embodiment, with reference now to FIGS. 2A through 2H, an exemplary folding caddy system 100 (for example, folding caddy system 200) comprises a pair of frame components 100A (e.g., caddy portion 210) coupled by pivot component 100B (e.g., pin 220). Via operation of pivot component 100B, folding caddy system 200 may be positioned in a "closed" position (e.g., where frame components 100A are disposed roughly parallel to one another) and an "open" position (e.g., where frame components 100A are disposed at an angle to one another, ready to accept a container at least partially therebetween). Moreover, folding caddy system 200 may comprise any suitable components and/or configurations for supporting a container in an inverted position.

In certain exemplary embodiments, a frame component 100A and a pivot component 100B may be integrally formed, for example via 3D printing, injection molding, and/or the like. In these exemplary embodiments, a frame component 100A having an integrally formed pivot component 100B may be coupled to another frame component 100A lacking an integrally formed pivot component 100B, for example via a snap fit, press fit, and/or the like. In various exemplary embodiments, folding caddy system 200 may be comprised entirely of a single material, for example thermoplastics such as polycarbonate, acetal plastic, ABS plastic, and/or the like.

Caddy portion 210 comprises a rigid component configured to support a container in an inverted position. With reference now to FIGS. 2A through 2D, in an exemplary embodiment, caddy portion 210 comprises a pair of legs 212, at least one support loop 214, and a bar 216. In another exemplary embodiment, caddy portion 210 comprises a pair of legs 212, at least one support loop 214, and a pin 220. Caddy portion 210 may be monolithic; alternatively, caddy portion 210 may be formed from a combination of components and/or materials. In an exemplary embodiment, caddy portion 210 comprises a thermoplastic material. In other exemplary embodiments, caddy portion 210 comprises a metal alloy. In still other exemplary embodiments, caddy portion 210 comprises a molded composite material. Caddy portion 210 may comprise any suitable rigid or semi-rigid material, for example plastic, metal, and/or the like.

Legs 212 are configured to support folding caddy system 200 against a surface, for example a countertop, a shelf, and/or the like. Legs 212 may be configured with padding and/or slip-resistant material on the bottom thereof in order to facilitate a sturdy and/or stable placement for folding caddy system 200.

Support loop 214 is configured to at least partially support a container. In various exemplary embodiments, support loop 214 is configured with an inner hole roughly the size of a condiment bottle. Support loop 214 may be angled, curved, and/or otherwise shaped to fit and/or accept a container or containers desired for storage in an inverted position. Moreover, support loop 214 may be configured to allow a container to rest thereon, for example at an angled and/or inverted position. In various exemplary embodiments, folding caddy system is configured such that a first support loop 214 disposed on one side of folding caddy system 200 is configured to receive a container at least partially therethrough, while a second support loop 214 disposed on a pivotably opposable side of folding caddy system 200 is configured to allow a container to rest thereon. In this manner, a container may be held securely in an inverted position in folding caddy system 200.

In an exemplary embodiment, caddy portion 210 comprises three support loops 214. In other exemplary embodiments, caddy portion 210 may comprise two support loops 214, four support loops 214, and/or any other suitable number of support loops 214, for example depending on a desired size of folding caddy system 100, a space available on a refrigerator shelf, and/or the like. Support loops 214 may be similarly sized to one another; moreover, a caddy portion 210 may be configured with support loops 214 of differing sizes, for example in order to accommodate containers of different sizes and/or shapes. Support loops 214 may be linked to one another, for example as illustrated in FIG. 2D, or separate, for example as illustrated in FIG. 2B.

Figure 2A:
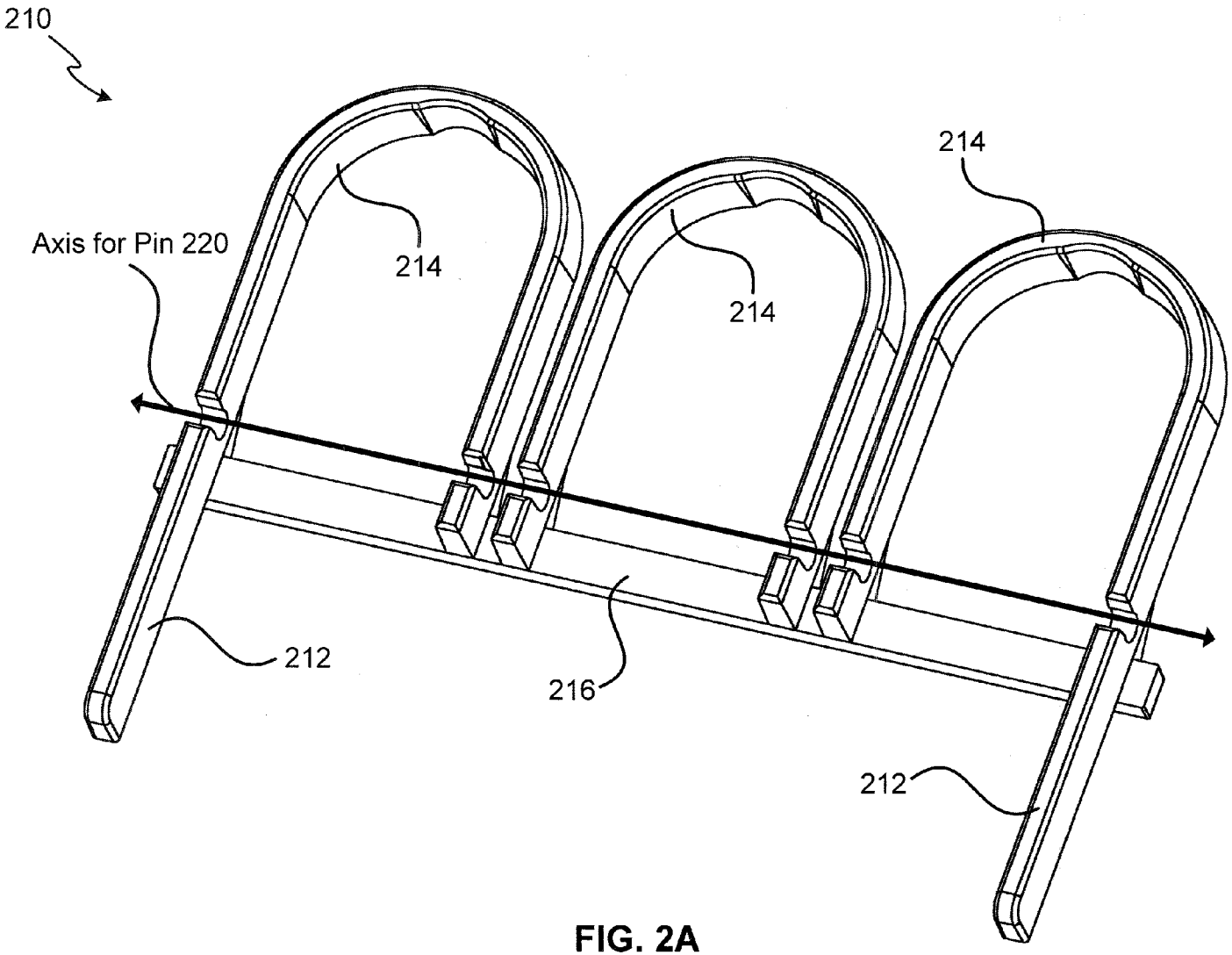
FIGS. 2A and 2B illustrate a caddy portion of an exemplary folding caddy system in accordance with an exemplary embodiment.
Figure 2B:
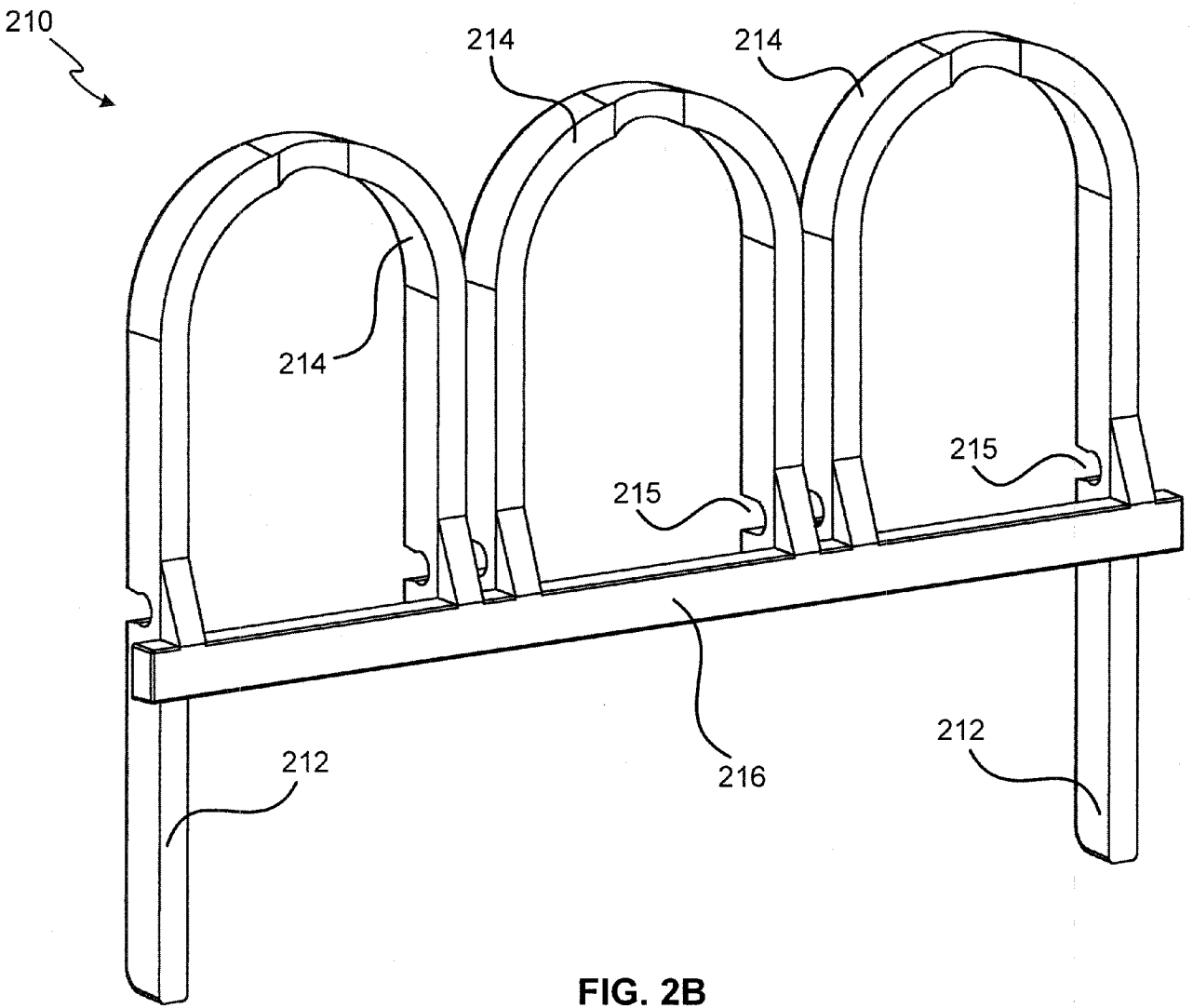
Figure 2C:
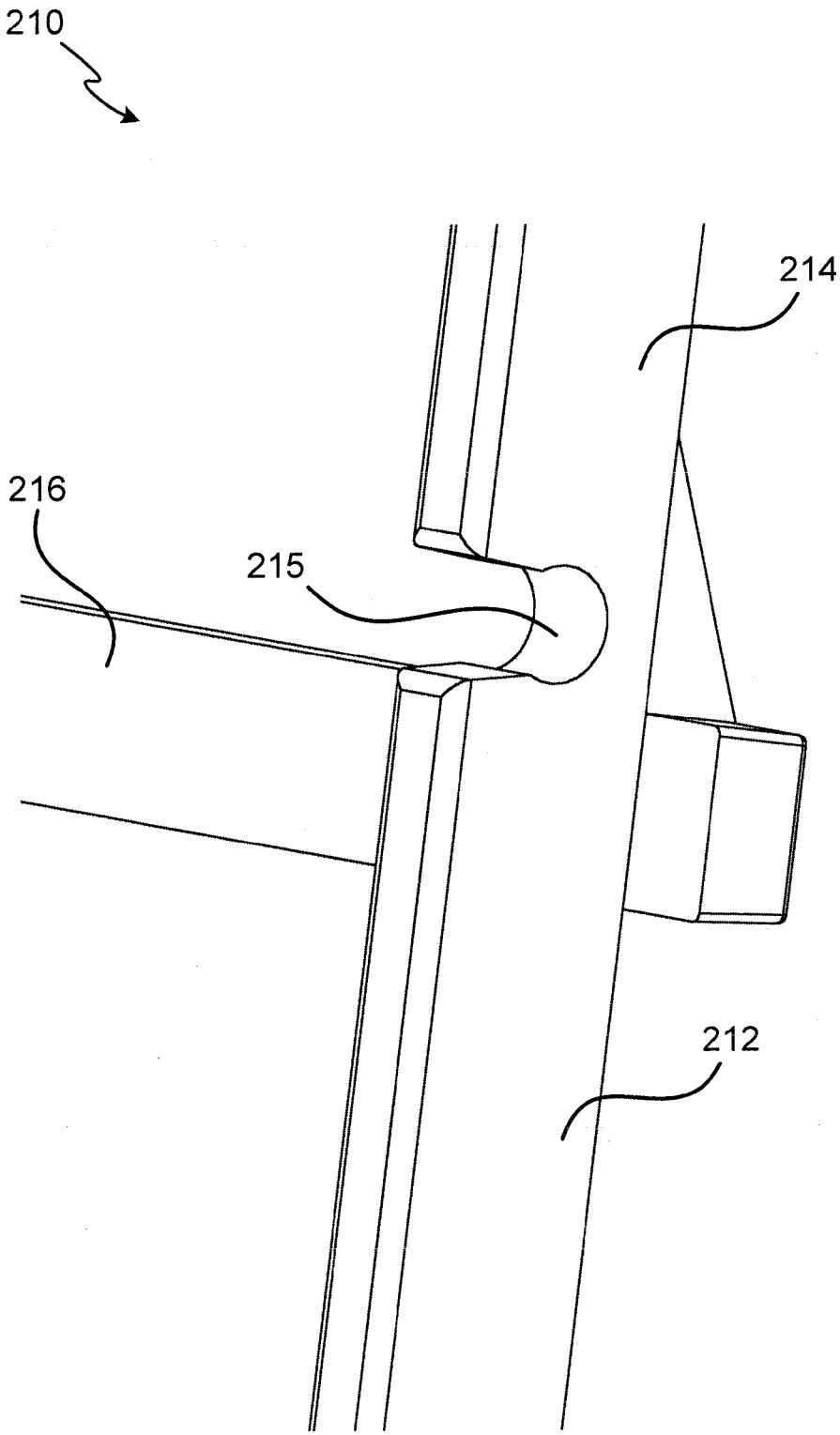
FIG. 2C illustrates a close-up view of part of a caddy portion of an exemplary folding caddy system in accordance with an exemplary embodiment.
Figure 2D:
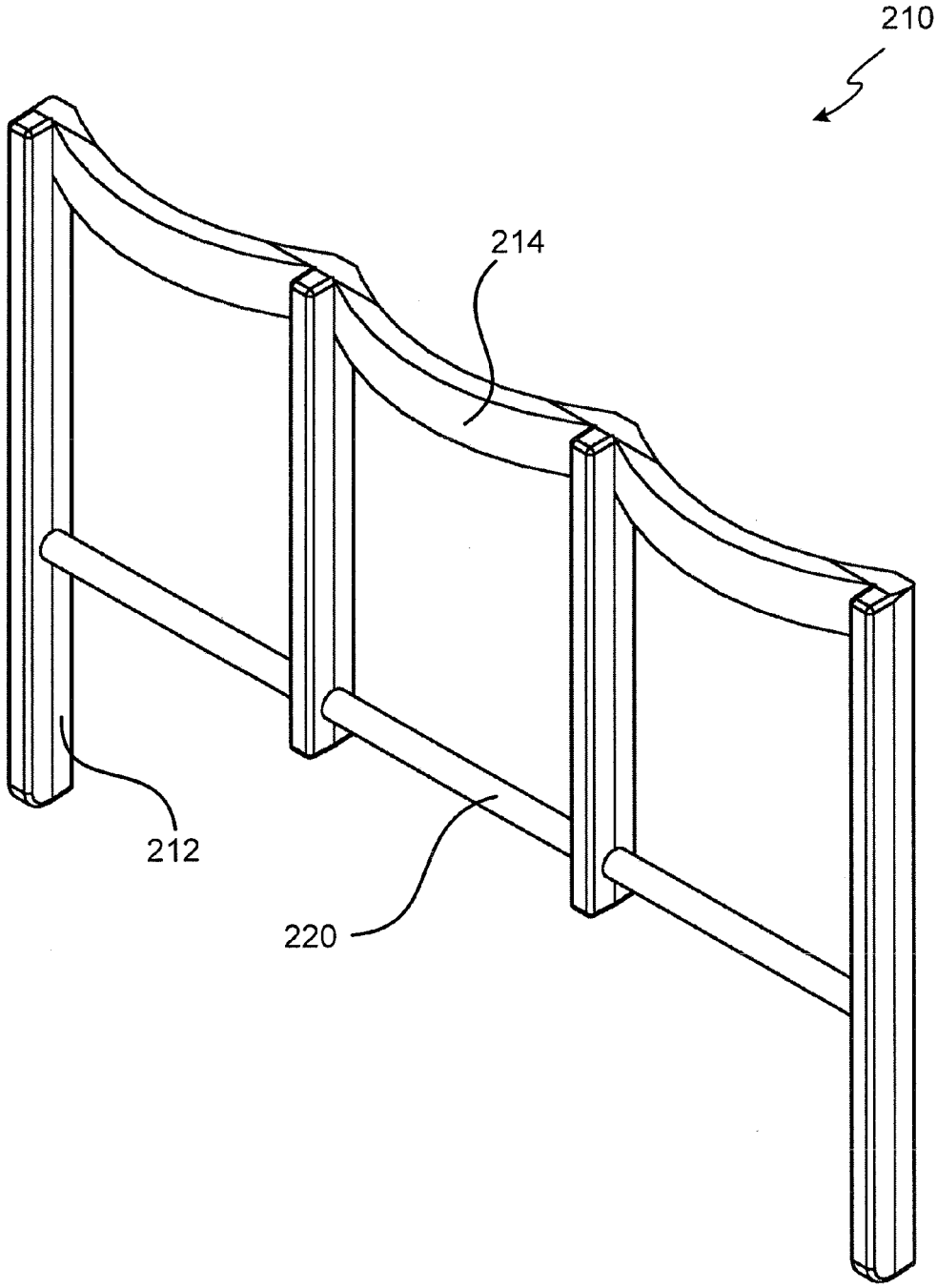
FIG. 2D illustrates a caddy portion of an exemplary folding caddy system in accordance with an exemplary embodiment.
Figure 2E:
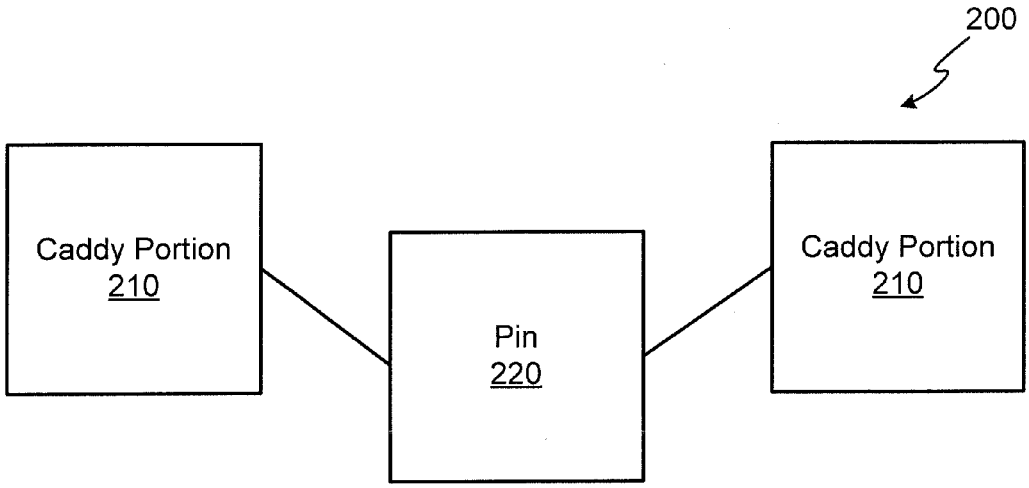
FIG. 2E is a block diagram of an exemplary folding caddy system in accordance with an exemplary embodiment.

A portion of a support loop 214 may extend to become (and/or be considered to be) a leg 212, for example as illustrated in FIGS. 2A and 2B. Moreover, support loop 214 may be coupled to and/or integrally formed with bar 216, pin 220, and/or other components of caddy portion 210.

Bar 216 is configured to provide structural support to caddy portion 210, and to at least partially govern and/or configure an angle for an opened position of folding caddy system 200. When a pair of caddy portions 210 are rotated with respect to one another via operation of pin 220, a bar 216 on the first caddy portion 210 comes into contact with a leg 212 on the second caddy portion 210 (or other suitable component of the second caddy portion 210), preventing further rotation of the two caddy portions 210 with respect to one another, and thus establishing an "open" configuration for folding caddy system 100. Bar 216 (and/or leg 212) may be sized, angled, and/or configured, as desired, in order to obtain a desired angle and/or orientation between caddy portions 210 when folding caddy system 200 is in an open position.

In various exemplary embodiments, pin 220 is configured to link at least two caddy portions 210 to one another in a pivotable manner. Pin 220 may comprise metal, plastic, and/or other suitable rigid material. Pin 220 may be coupled to caddy portions 210 in any suitable manner. In an exemplary embodiment, pin 220 is coupled to and/or passes through a series of notches 215 formed in support loops 214. Pin 220 may also provide structural support to caddy portion 210; stated another way, pin 220 may replace bar 216 in certain exemplary embodiments.

In some exemplary embodiments, pin 220 is integrally formed (for example, via molding) with a caddy portion 210. In these exemplary embodiments, a caddy portion 210 having pin 220 may be directly coupled to a caddy portion 210 lacking pin 220, for example via a snap fit, press fit, and/or the like. Stated another way, with momentary reference to FIG. 2G, folding caddy system 200 may comprise a pair of complementary caddy portions 210-A (having pin 220) and 210-B (having a series of notches 215 to receive pin 220), snappable together to form folding caddy system 200.

Figure 2F:
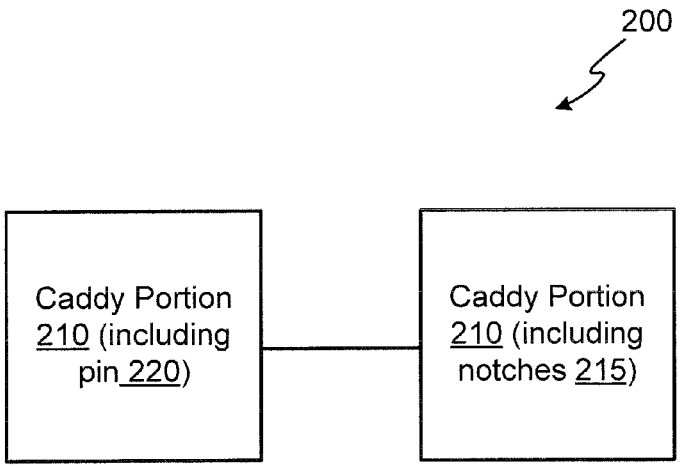
FIG. 2F is a block diagram of an exemplary folding caddy system in accordance with an exemplary embodiment.
Figure 2G:
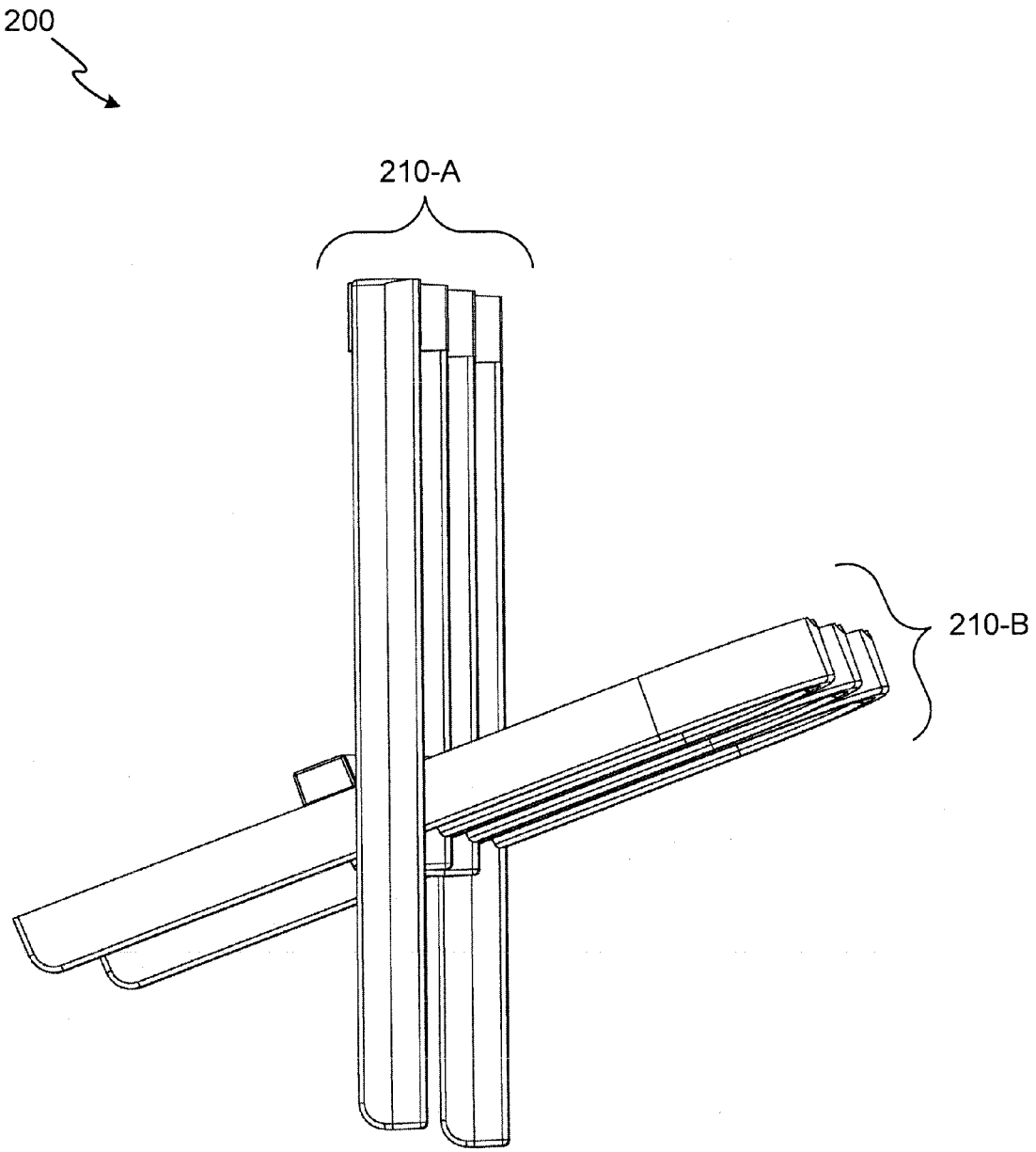
FIGS. 2G and 2H illustrate an exemplary folding caddy system in an opened position in accordance with an exemplary embodiment.
Figure 2H:
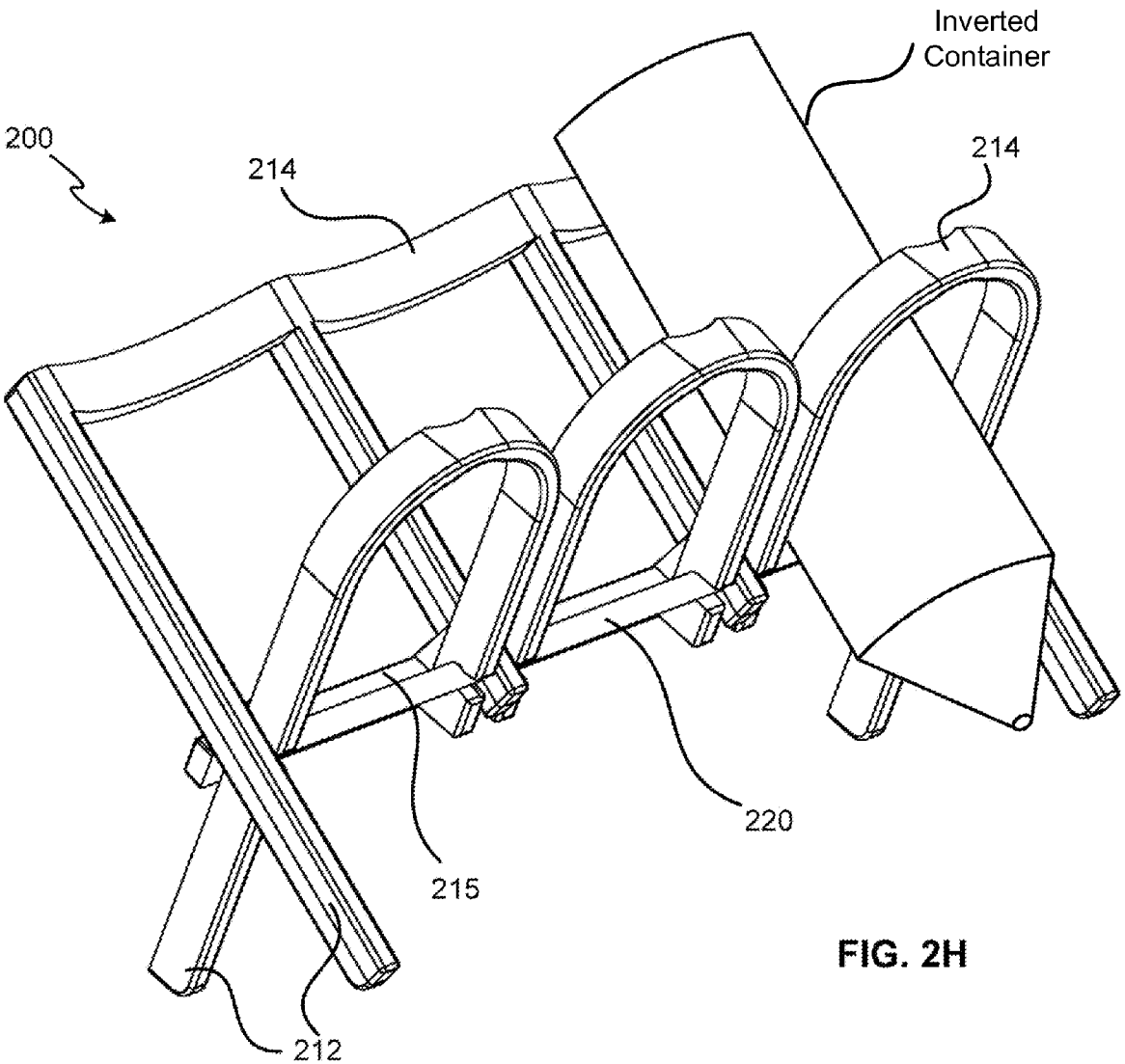

It will be appreciated that in folding caddy system 200, for example as illustrated in FIGS. 2F through 2H, a first caddy portion 210 may be configured with a bar 216 and notches 215, while a second caddy portion 210 may be configured with a pin 220 (instead of a bar 216).

When coupled via pin 220, it will be appreciated that caddy portions 210 may be slightly offset from one another. Stated differently, caddy portions 210 may at least partially interlock and/or pass between portions of one another when folding caddy system 200 is in a "closed" (i.e., folded) position. In this manner, folding caddy system 200 may be made more compact when folded, for example having an overall thickness less than twice the thickness of a caddy portion 210.

In an exemplary embodiment, folding caddy system 200 is configured to fit on a refrigerator shelf. In this embodiment, folding caddy system 200 is configured with folded/closed dimensions of about ¼ inch width, 7 inches in height, and 8 inches in length. In this embodiment, folding caddy system 200 is configured with unfolded/opened dimensions of about 4.5 inches in width, 5 inches in height, and 8 inches in length. Moreover, folding caddy system 200 may be sized, as desired, for example in order to fit into a selected location (e.g., a shelf, countertop, nook, and/or the like) and/or to accommodate a certain size of container or containers.

Figure 3:
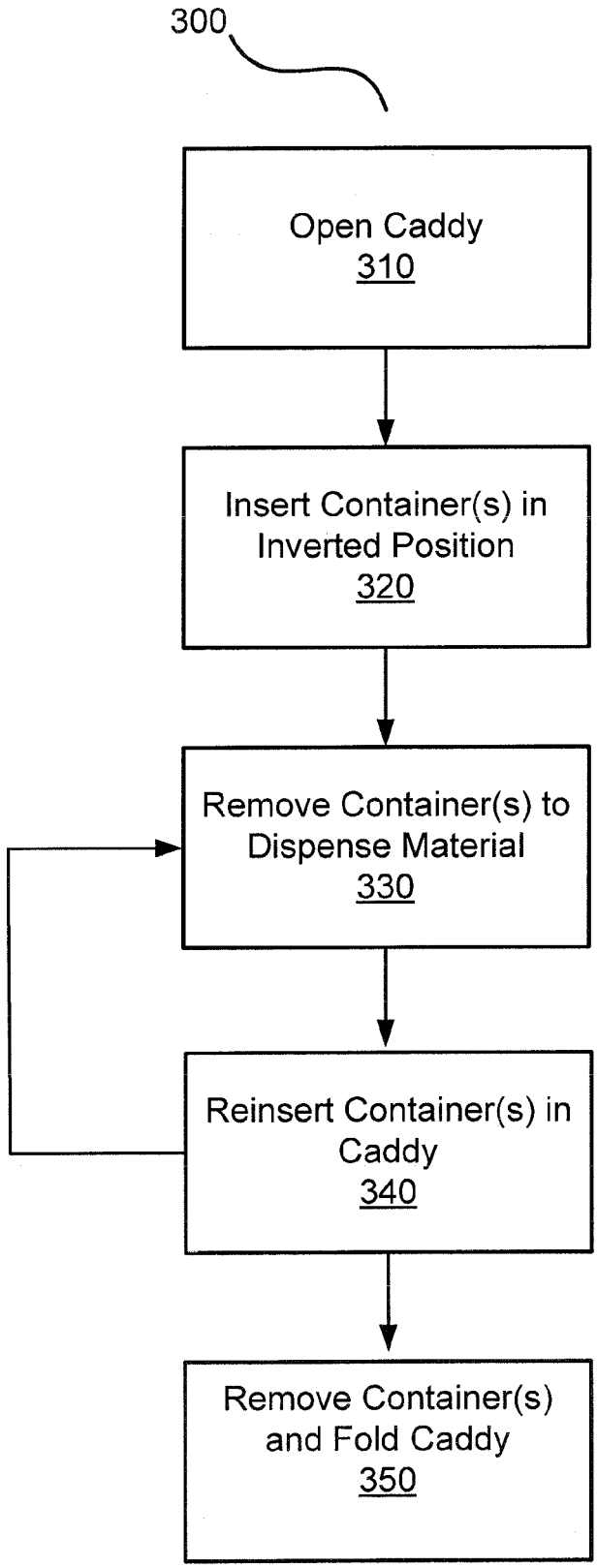
FIG. 3 illustrates a method for using a folding caddy in accordance with an exemplary embodiment.

In operation, folding caddy system 200 is openable and closable in a scissor-like fashion. With reference now to FIG. 3, in an exemplary embodiment, a method 300 for using a folding caddy system comprises opening the folding caddy system and placing the legs in contact with a surface (step 310). A container is inserted into the folding caddy system in an inverted position (step 320), allowing the contents of the container to move, over time, toward the cap for more efficient and quicker dispensing. The container may be removed from the folding caddy system to dispense the contents (step 330). When dispensing is complete, the container may be reinserted into the folding caddy system (step 340), in order to allow the contents to again collect at the cap side of the container for efficient dispensing. Steps 330 and 340 may be repeated, as desired, for example until the container is empty or nearly empty. For transportation, cleaning, and/or the like, the container(s) may be removed from the folding caddy and the folding caddy may be moved to the folded or "closed" position.

While the principles of this disclosure have been shown in various embodiments, many modifications of structure, arrangements, proportions, the elements, materials and components, used in practice, which are particularly adapted for a specific environment and operating requirements may be used without departing from the principles and scope of this disclosure. These and other changes or modifications are intended to be included within the scope of the present disclosure.

The present disclosure has been described with reference to various embodiments. However, one of ordinary skill in the art appreciates that various modifications and changes can be made without departing from the scope of the present disclosure. Accordingly, the specification is to be regarded in an illustrative rather than a restrictive sense, and all such modifications are intended to be included within the scope of the present disclosure. Likewise, benefits, other advantages, and solutions to problems have been described above with regard to various embodiments. However, benefits, advantages, solutions to problems, and any element(s) that may cause any benefit, advantage, or solution to occur or become more pronounced are not to be construed as a critical, required, or essential feature or element.

As used herein, the terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. Also, as used herein, the terms "coupled," "coupling," or any other variation thereof, are intended to cover a physical connection, an electrical connection, a magnetic connection, an optical connection, a communicative connection, a functional connection, and/or any other connection.

What is claimed is:

1. A folding caddy, comprising:

a first caddy portion; and a second caddy portion pivotably coupled to the first caddy portion about an axis of rotation, wherein, when the folding caddy is in an open position, the folding caddy is configured to receive a container at an inverted angle, wherein the first caddy portion comprises a first support loop configured to permit, when the folding caddy is in an open position, a portion of the inverted container to pass therethrough, and wherein the first support loop comprises two parallel sections linked by a semicircular section, the curvature of the semicircular section being co-planar with the axis of rotation, wherein the second caddy portion comprises a second support loop configured to support, when the folding caddy is in the open position, the inverted container, and wherein the second support loop comprises two parallel sections linked by a curved section, the curvature of the curved section not being co-planar with the axis of rotation, and wherein the first support loop and the second support loop are disposed on pivotably opposable sides of the folding caddy.

2. The folding caddy of claim 1, wherein the semicircular section of the first support loop extends in an upward direction when the folding caddy is in the open position, and wherein the curved section of the second support loop extends in a downward direction when the folding caddy is in the open position.

3. The folding caddy of claim 1, wherein the first caddy portion and the second caddy portion are rotatable about the axis of rotation to at least partially interlock when viewed along the axis.

4. The folding caddy of claim 1, wherein the first caddy portion is monolithic and the second caddy portion is monolithic.

5. The folding caddy of claim 1, wherein the first caddy portion further comprises:

a first set of legs coupled to the first support loop; and a bar coupled to the first set of legs and extending therebetween;

wherein the second caddy portion further comprises a second set of legs coupled to the second support loop, and wherein, responsive to rotation of the first caddy portion and the second caddy portion about the axis of rotation, the bar engages the second set of legs to establish an endpoint of rotation of the first caddy portion with respect to the second caddy portion.

6. The folding caddy of claim 1, wherein the first caddy portion further comprises a third support loop and a fifth support loop, wherein the second caddy portion further comprises a fourth support loop and a sixth support loop, wherein the third support loop and the fourth support loop are disposed on pivotably opposable sides of the folding caddy, and wherein the fifth support loop and the sixth support loop are disposed on pivotably opposable sides of the folding caddy.

7. The folding caddy of claim 6, wherein the first support loop is a different size than at least one of the third support loop or the fifth support loop.

8. The folding caddy of claim 1, wherein the first caddy portion and the second caddy portion at least partially interlock when the folding caddy is in a closed position, and wherein the thickness of the folding caddy in the closed position is less than twice the thickness of either the first caddy portion or the second caddy portion.

9. A method of using a folding caddy, the method comprising:

positioning a folding caddy in an open position;

inserting a container into the folding caddy in an inverted orientation;

removing the container from the folding caddy to dispense a viscous material from the container; and reinserting the container into the folding caddy in an inverted orientation, wherein the folding caddy comprises:

a first caddy portion; and a second caddy portion pivotably coupled to the first caddy portion about an axis of rotation, wherein, when the folding caddy is in an open position, the folding caddy is configured to receive a container at an inverted angle, wherein the first caddy portion comprises a first support loop configured to permit, when the folding caddy system is in an open position, a portion of the inverted container to pass therethrough, wherein the second caddy portion comprises a second support loop configured to support, when the folding caddy system is in an open position, the inverted container, and wherein the first support loop and the second support loop are disposed on pivotably opposable sides of the folding caddy system.

10. The method of claim 9, wherein the inserting the container into the folding caddy in an inverted orientation causes the viscous material to accumulate near a dispensing opening in the container.

11. The method of claim 9, wherein the first support loop comprises two parallel sections linked by a semicircular section, the curvature of the semicircular section being co-planar with the axis of rotation, and wherein the second support loop comprises two parallel sections linked by a curved section, the curvature of the curved section not being co-planar with the axis of rotation.

* * * * *